US010077136B2

(12) United States Patent
Tresso et al.

(10) Patent No.: US 10,077,136 B2
(45) Date of Patent: Sep. 18, 2018

(54) PHASE-CHANGE ACCOMMODATING RIGID FLUID CONTAINER

(71) Applicant: RMB Products, Inc., Fountain, CO (US)

(72) Inventors: Riccardo J. Tresso, Castle Rock, CO (US); Bart Carter, Pueblo, CO (US); Scott Eickhoff, Colorado Springs, CO (US); Alejandro Llamas, Colorado Springs, CO (US); Jason Davidson, Fountain, CO (US); Craig Jack, Denver, CO (US); Mark A. Petrich, West Point, PA (US); Scott McFeaters, West Point, PA (US); Anthony Flammino, West Point, PA (US); Dan Elliott, Fountain, CO (US); Jeff Johnson, West Point, PA (US)

(73) Assignee: RMB Products, Inc., Fountain, CO (US)

( * ) Notice: Subject to any disclaimer, the term of this patent is extended or adjusted under 35 U.S.C. 154(b) by 444 days.

(21) Appl. No.: 14/736,633

(22) Filed: Jun. 11, 2015

(65) Prior Publication Data

US 2015/0360815 A1 Dec. 17, 2015

Related U.S. Application Data

(60) Provisional application No. 62/010,681, filed on Jun. 11, 2014.

(51) Int. Cl.
*B65D 21/02* (2006.01)
*B65D 25/02* (2006.01)
(Continued)

(52) U.S. Cl.
CPC ..... *B65D 25/02* (2013.01); *B65B 63/08* (2013.01); *B65D 25/34* (2013.01); *B65D 25/42* (2013.01);
(Continued)

(58) Field of Classification Search
CPC .. B65D 21/02; B65D 21/0231; B65D 23/102; A01C 7/04; A47G 19/12
(Continued)

(56) References Cited

U.S. PATENT DOCUMENTS 6,270,488 B1 * 8/2001 Johnson ..... A61M 1/0001 604/403
2005/0051575 A1 3/2005 Durivage
(Continued)

FOREIGN PATENT DOCUMENTS

GB 2473256 A 3/2011
WO 01/52761 A1 7/2001
(Continued)

OTHER PUBLICATIONS

European Search Report, European Patent Office, dated Nov. 24, 2017.
(Continued)

*Primary Examiner* — King M Chu
(74) *Attorney, Agent, or Firm* — Holzer Patel Drennan

(57) ABSTRACT

The phase-change accommodating rigid fluid container disclosed herein includes a variety of features that protect the container from phase changes of a fluid stored therein. As a result, the container may be in direct contact with the fluid without any flexible membrane or bag there between. For example, the fluid container may include one or more of matched pairs of recesses for physical manipulation of the container, stiffening ribs extending between the recesses, and input/output assemblies acting as inputs for fluid into the
(Continued)

container, outputs of fluid from the container, and vents for pressure equalization of the container.

23 Claims, 15 Drawing Sheets

(51) Int. Cl.

| | |
|---|---|
| ***B65B 63/08*** | (2006.01) |
| ***B65D 25/34*** | (2006.01) |
| ***B65D 25/42*** | (2006.01) |
| *B65D 85/00* | (2006.01) |
| *B65D 25/00* | (2006.01) |

(52) U.S. Cl.
CPC ..... *B65D 21/0202* (2013.01); *B65D 25/00* (2013.01); *B65D 85/70* (2013.01); *B65D 2213/00* (2013.01); *Y10T 29/49828* (2015.01)

(58) Field of Classification Search
USPC ..... 215/398; 222/465.1, 216, 143; 206/216
See application file for complete search history.

(56) References Cited

U.S. PATENT DOCUMENTS

| | | | | |
|---|---|---|---|---|
| 2007/0240432 | A1 | 10/2007 | Voute et al. | |
| 2008/0314052 | A1 | 12/2008 | Shin | |
| 2010/0072216 | A1 | 3/2010 | Voute et al. | |
| 2012/0187005 | A1* | 7/2012 | Pritchard ..... | B01D 61/08 206/216 |

FOREIGN PATENT DOCUMENTS

| | | |
|---|---|---|
| WO | 2007/065141 | 6/2007 |
| WO | 2007/065142 | 6/2007 |

OTHER PUBLICATIONS

International Searching Authority; International Search Report and Written Opinion; dated Sep. 24, 2015, 9 pages.

* cited by examiner

Section A-A

Section B-B

PHASE-CHANGE ACCOMMODATING RIGID FLUID CONTAINER

CROSS-REFERENCE TO RELATED APPLICATIONS

The present application claims benefit of priority to U.S. Provisional Patent Application No. 62/010,681, entitled "Freeze/Thaw Fluid Container with Combined Inlet/Outlet" and filed on Jun. 11, 2014, which is specifically incorporated by reference herein for all that it discloses or teaches.

BACKGROUND

Conventional fluid containers, including both rigid and compliant containers, come in a variety of shapes and sizes with a variety of features, some of which accommodate a fluid phase change within the container. For example, some fluids (e.g., medical fluids) are stored and transported in compliant bags, which offer flexibility in the event the fluid freezes, but poor protection from physical puncture of the bag, which may contaminate the fluid. Other fluids are stored and transported in rigid containers, which may provide better protection from physical puncture, but may fracture due to expansion and contraction of the fluid as it freezes and thaws. Still other fluids are stored in a combination container (e.g., a flexible bag inside a rigid container), which may offer some of the benefits of each type of container, but with the added expense of redundant storage containers for a defined volume of fluid.

Each of the conventional rigid, compliant, and combined fluid containers lack a combination of features that comprehensively protects the container from fluid phase changes and external threats to the container while permitting easy physical manipulation of the container, including freeze/thaw resistance, puncture resistance, and input/output assemblies that are both protected and easy to use, for example.

SUMMARY

Implementations described and claimed herein address the foregoing problems by providing a fluid container comprising: two or more matched pairs of recesses in a body of the container, each recess in a matched pair oriented on opposing sides of the container, the recesses configured to interface with hardware to physically manipulate the container; and two or more stiffening ribs, each stiffening rib extending between two of the recesses in the body of the container.

Implementations described and claimed herein address the foregoing problems by further providing a method of using a fluid container comprising: interfacing each of two or more matched pairs of recesses in a body of the container with manipulation hardware, each recess in a matched pair oriented on opposing sides of the container; and suspending the container from the recesses, wherein each of two or more stiffening ribs extend between two of the recesses in the body of the container.

Other implementations are also described and recited herein.

BRIEF DESCRIPTIONS OF THE DRAWINGS

DETAILED DESCRIPTIONS

Figure 1:
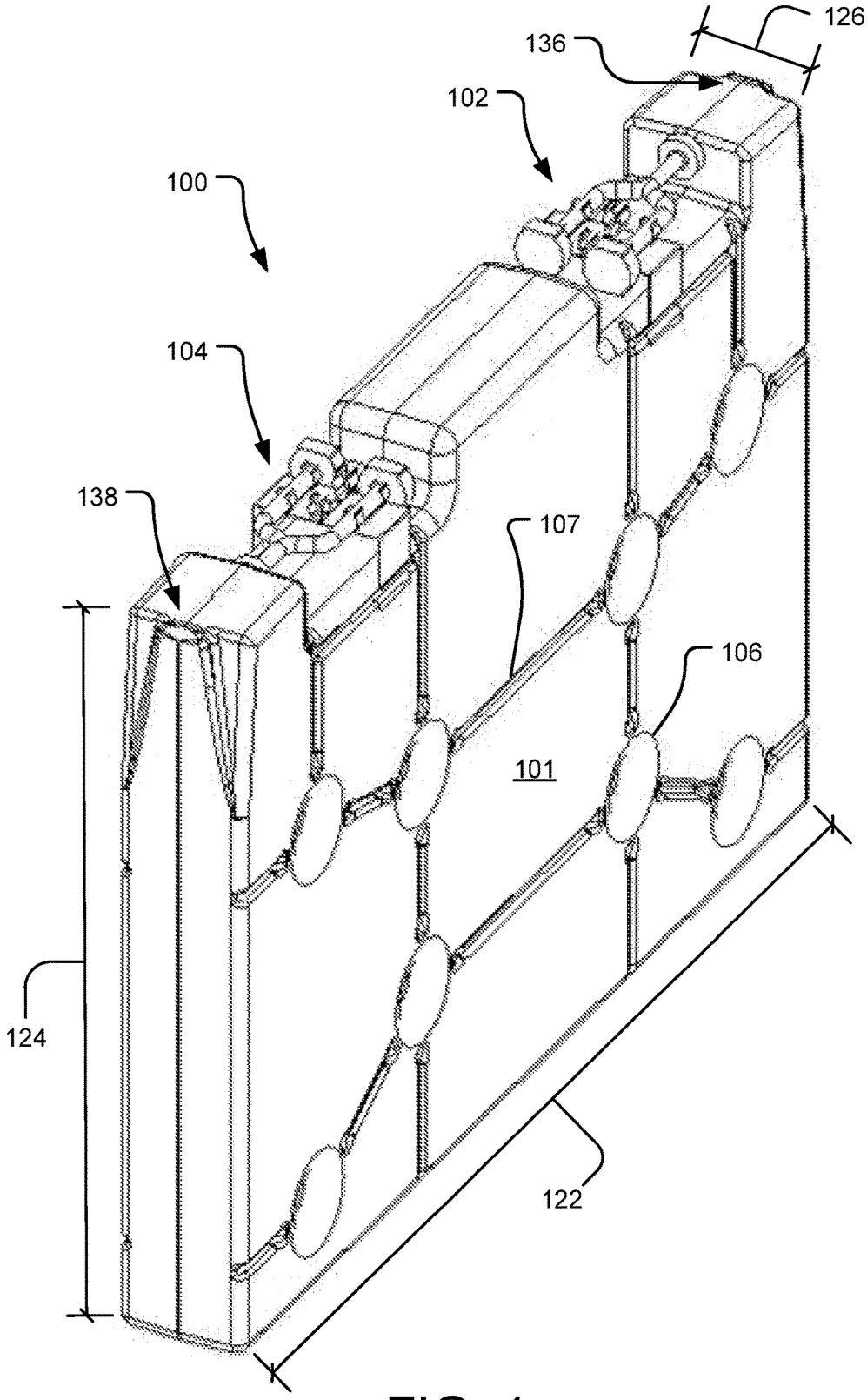
FIG. 1 is a perspective view of an example phase-change accommodating rigid fluid container.

FIG. 1 is a perspective view of an example phase-change accommodating rigid fluid container (alternatively, a "phase change fluid container" or a "container") 100. The container 100 includes a variety of features discussed in detail herein that protect the container 100 from phase changes of a fluid (not shown) stored therein. As a result, the container 100 may be in direct contact with the fluid without any flexible membrane or bag there between.

The container 100 includes a body 101 that is depicted as generally a rectangular box, but may be another volume-enclosing shape or combination of shapes with one or more of the features described in detail below. Further, the container 100 may be any size (e.g., 2 liters to 200 liters) and used for storing any fluid (e.g., medical or pharmaceutical fluids). Still further, the container 100 may be made of any suitable material (e.g., various plastics (polyethylene), metals, or composite materials) using any suitable manufacturing process (e.g., molding (rotational molding, injection molding, extrusion molding, blow molding), welding, etc.). Further still, the container 100 is rigid in that it holds a defined shape when not under stress imposed by the fluid stored therein. The rigid container 100 may deform to accommodate a phase change of the fluid (e.g., the container may bow outward when the fluid freezes). Further yet, the container 100 may be configured for a single use (i.e., fill and discharge once), multiple uses (i.e., repeated fills and discharges), short-term storage, and/or long term storage of the fluid.

The container 100 is generally defined as having an exterior length 122, exterior height 124, and exterior width 126 and a relatively constant wall thickness (not shown). In other implementations, the wall thickness may vary such that higher stress areas of the container 100 have thicker walls for more strength and lower stress areas of the container 100 have thinner walls for more flexibility and cost/weight savings. In order to achieve the desired freeze/thaw performance, the container 100 has length/width and height/width aspect ratios that vary from 4 to 10. The relatively high aspect ratio dimensional characteristics of the container 100 allows the fluid therein to freeze relatively quickly on outside surfaces mostly defined by the width of the container 100. Within the interior of the container 100, the last part of the fluid to freeze pushes upward, displacing some headspace without damaging or significantly deforming the container 100. In some implementations, the container 100 is designed with sufficient strength to withstand some stress induced by the fluid freezing (see e.g., stiffening ribs, discussed in detail below) and may allow some flexure to also accommodate the stress induced by the fluid freezing within the container 100.

The container 100 further includes a pair of input/output assemblies 102, 104 that are used for filling and discharging the container 100 as described in detail below with reference to FIG. 4. The input/output assemblies 102, 104 may also be used as vents, which provide fluidic communication with the atmosphere and allow fluid to be added and removed from the container 100 and the fluid within the container 100 to freeze and thaw without building pressure within the container 100. In some implementations, the input/output assemblies 102, 104 incorporate filters and/or screens that prevent contaminants from entering the container 100 or leaving the container 100, either via a filling or discharging fluid stream or an entering or exiting venting gas stream.

Further, the input/output assemblies 102, 104 are recessed into the body 101 (see recesses 216, 218 of FIG. 2) to help protect against impact damage during manipulation of the container 100 or manipulation of equipment or other objects in close proximity to the container 100. Recessing the input/output assemblies 102, 104 increases the likelihood that an impact sustained by the container 100 is absorbed by the body 101 rather than the input/output assemblies 102, 104 themselves.

The container 100 also includes a pair of troughs 136, 138 that are used in conjunction with the input/output assemblies 102, 104, respectively. For example, when the input/output assembly 104 is used to drain the fluid from the container 100, the container 100 may be rotated such that the trough 138 is oriented at the bottom of the container 100 (see e.g., FIG. 11). Gravity forces the fluid toward the trough 138 and the trough 138 serves to funnel the fluid to a point located at the very bottom of the container 100 where a straw (not shown, see e.g., FIG. 4) is utilized by the input/output assembly 104 to withdraw the maximum amount of fluid from the container 100 with a minimum amount of waste fluid that remains unobtainable. In various implementations, the remaining unobtainable waste fluid is less than 0.1% of the total volume of the container 100. In other implementations, the remaining unobtainable waste fluid is about than 0.06% of the total volume of the container 100.

The container 100 also includes an array of manipulation recesses (e.g., recess 106) in the body 101. The interior of each of the recesses is fully closed such that the container 100 is sealed from the atmosphere aside from the input/output assemblies 102, 104. The container 100 may be physically secured and manipulated via the recesses. For example, pins or rods (not shown) may extend into two or more of the recesses and the container 100 may be moved or manipulated by moving the pins or rods in unison or with reference to one another.

In another example, straps (not shown) may extend into one or more of the recesses that permit the container 100 to be moved or manipulated by moving the straps in unison or with reference to one another. While eight cylindrical recesses are depicted extending into the container 100, the recesses may be any size, shape, or number appropriate for the intended movement or manipulation of the container 100. Further, the recesses may taper through the width of the container 100 for ease of manufacturing. The recesses may also each include a countersink or counterbore surrounding the individual recesses (see e.g., FIG. 2). The countersink or counterbore may increase localized stiffness and/or rigidity at the recesses and may also serve to guide the pins, rods, or straps to the recesses when the pins, rods, or straps are interfaced with the container 100, and may serve to recess corresponding pin, rod, or strap fastening hardware within the surrounding body 101.

In some implementations, the recesses do not extend completely through the container body 101. As a result, the recesses are utilized by pressing corresponding pins from each side of the container body 101 into a recess to manipulate the recess. The recesses that may or may not extend entirely through the container body 101 are collectively referred to herein as lifting points.

The container 100 also includes stiffening ribs (e.g., rib 107) that provide additional stiffness to the sidewalls of the container 100. The stiffening ribs are formed channels in the body 101 of the container 100 that may protrude inward relative to the surrounding body 101 (as shown herein), or protrude outward relative to the surrounding body 101. Further, the stiffening ribs approach the recesses, but stop short of connecting the recesses to preserve the structural integrity of the recesses and avoid introducing any rapid transitions that may lead to reduced thickness of material in some manufacturing processes. In other implementations, the stiffening ribs connect the recesses, which may provide additional strength to the recesses when they are used as lifting points. Use of the stiffening ribs to increase strength at the recesses may also increase localized stiffness and/or rigidity at the recesses.

Figure 2:
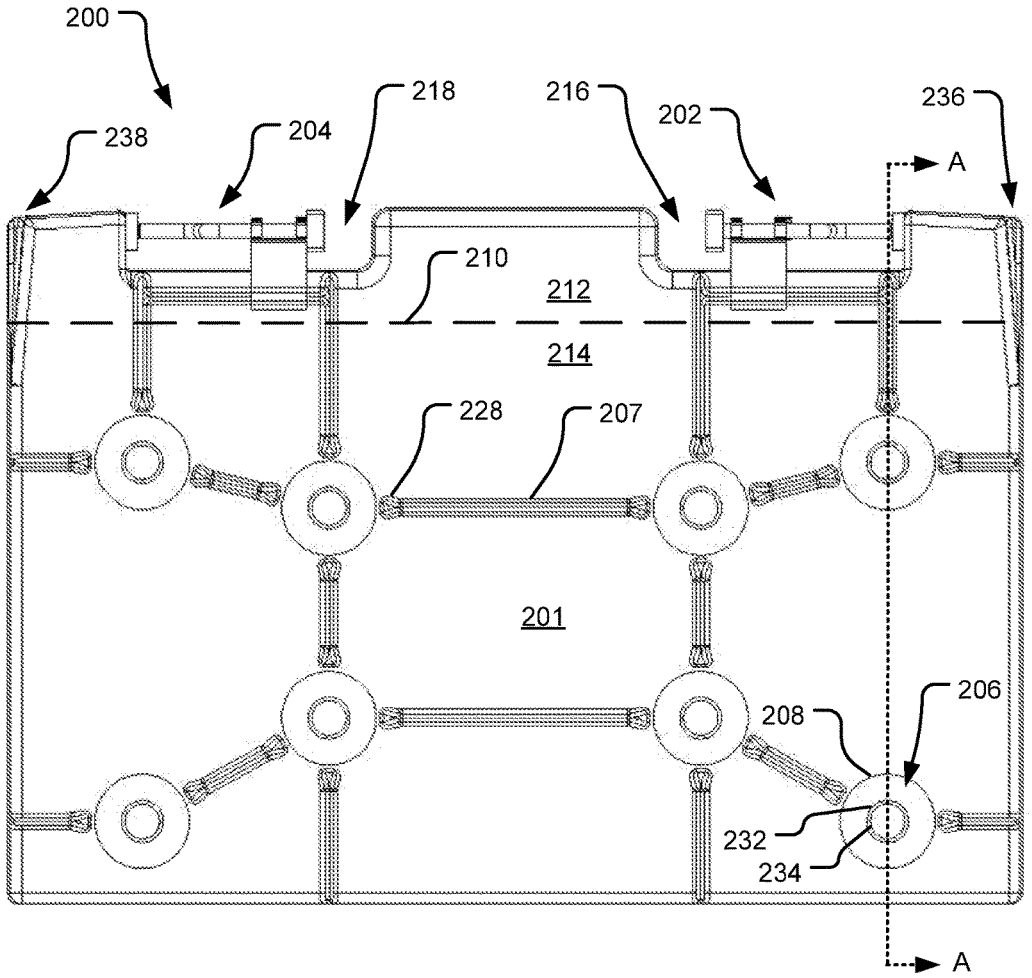
FIG. 2 is an elevation view of an example phase-change accommodating rigid fluid container.

FIG. 2 is an elevation view of an example phase-change accommodating rigid fluid container 200 in a freeze/thaw (or phase-change) orientation. The container 200 includes a variety of features discussed in detail herein that protect the container 200 from phase changes of a fluid 214 existing below fluid line 210. Headspace 212 exists above the fluid line 210. By orienting the container 200 in the freeze/thaw orientation as shown, each of a pair of input/output assemblies 202, 204 are in the headspace 212 and thus not susceptible to damage due to freeze expansion and thaw contraction of the fluid 214. The container 200 includes a body 201 that is depicted as generally a rectangular box, but may be another volume-enclosing shape or combination of shapes with one or more of the features described herein.

The pair of input/output assemblies 202, 204 are used for filling and discharging the container 200 as described in detail below with reference to FIG. 4. The input/output assemblies 202, 204 may also be used as vents, which provide fluidic communication with the atmosphere and allow fluid to be added and removed from the container 200 and the fluid 214 within the container 200 to freeze and thaw without building pressure within the container 200.

The container 200 still further includes input/output recesses 216, 218 that recess the input/output assemblies 202, 204 into the body 201 to help protect against impact damage during manipulation of the container 200 or manipulation of equipment or other objects in close proximity to the container 200. Recessing the input/output assemblies 202, 204 increases the likelihood that an impact sustained by the container 200 is absorbed by the body 201 rather than the input/output assemblies 202, 204 themselves.

The container 200 also includes a pair of troughs 236, 238 that are used in conjunction with the input/output assemblies 202, 204, respectively. For example, when the input/output assembly 204 is used to drain the fluid from the container 200, the container 200 may be rotated such that the trough 238 is oriented at the bottom of the container 200 (see e.g., FIG. 11). Gravity forces the fluid toward the trough 238 and the trough 238 serves to funnel the fluid to a point located at the very bottom of the container 200 where a straw (not shown, see e.g., FIG. 4) is utilized by the input/output assembly 204 to withdraw the maximum amount of fluid from the container 200 with a minimum amount of waste fluid that remains unobtainable.

The container 200 also includes an array of manipulation recesses (e.g., recess 206) in the body 201. The interior of each of the recesses is fully closed such that the container 200 is sealed from the atmosphere aside from the input/output assemblies 202, 204. The container 200 may be physically secured and manipulated via the recesses.

While eight cylindrical recesses are depicted in the container 200, the recesses may be any size, shape, or number appropriate for the intended movement or manipulation of the container 200. The recesses may also each include a countersink or counterbore (e.g., countersink or counterbore 208) surrounding the individual recesses. The countersink or counterbore may increase localized stiffness and/or rigidity at the recesses and may also serve to guide manipulation hardware to the recesses when the manipulation hardware is interfaced with the container 200. The countersink or counterbore may also serve to recess a portion of the manipulation hardware within the surrounding body 201. In implementations that utilize countersinks at each recess, the countersinks may serve to aid alignment with the manipulation hardware that may be imprecisely directed at the recesses (i.e., a self-centering feature).

Further, each recess may have a draft angle that narrows the recess toward a center of the container 200. For example, recess 206 has a countersink 208. At a base of the countersink 208, the recess 206 has recess diameter 232. The recess 206 has a further draft angle that concentrically narrows the recess 206 to recess diameter 234, which is less than recess diameter 232 by virtue of the draft angle. In various implementations, the draft angle may vary from 1-10 degrees. In addition, the recess diameter 234 may exist at a center of the overall width of the container 200, with the draft angle narrowing the recess diameter from recess diameter 232 to recess diameter 234 from each side of the container 200 in a mirror image (only one side of the container 200 is shown in FIG. 2). In other implementations, the draft angle may extend through the entire width of the container 200 and thus the recess diameters 232, 234 exist at opposing surfaces of the container body 201. In various implementations, the draft angle aids in manufacturing the container 200. In other implementations, the recesses do not incorporate a draft angle. In addition, in some implementations, the recesses do not extend completely through the container body 201 and are entirely counterbores or countersinks in the container body 201.

The container 200 also includes stiffening ribs (e.g., rib 207) that provide additional stiffness to the sidewalls of the container 200. The stiffening ribs are formed channels in the body 201 of the container 200 that may protrude inward relative to the surrounding body 201 (as shown herein), or protrude outward relative to the surrounding body 201. Further, the stiffening ribs approach the recesses, but stop short of connecting the recesses to preserve the structural integrity of the recesses and avoid introducing any rapid transitions that may lead to reduced thickness of material in some manufacturing processes. Further, the stiffening ribs may be used to further reinforce the input/output recesses 216, 218 as shown. In other implementations, the stiffening ribs connect the recesses, which may provide additional strength to the recesses when they are used as lifting points. Use of the stiffening ribs to increase strength at the recesses may also increase localized stiffness and/or rigidity at the recesses.

In some implementations, the stiffening ribs include flared ends (e.g., flared end 228) that provide smoother transitions to the surrounding body 201. As a result, the flared ends may reduce the occurrence of stress concentrations in the body 201 and reduce localized thinning of material that would otherwise occur when manufacturing the container 200 with more abrupt transitions. In other implementations, the stiffening ribs do not include flared ends.

The container 200 is depicted mostly full with the fluid 214 existing below the fluid level 210 and the small headspace 212 existing above the fluid level 210. The container 200 is capable of storing any fluid, however, the container 200 is particularly adapted to store fluids under pressure and temperature conditions where a phase change between a solid phase and a liquid phase is possible or expected. The fluid 214 may fill any percentage of the container 200 up to a 100% fill state by volume. In some implementations, the fluid 214 is not permitted to fill the container 200 up to the 100% fill state in a liquid phase to provide sufficient room for expansion as the liquid phase fluid turns into a solid phase (i.e., the fluid 214 freezes). The fluid 214 may also not be permitted to fill the container 200 to a level that partially or fully occupies the input/output recesses 216, 218 to avoid potentially damaging the input/output assemblies 202, 204 during a phase change.

The remaining percentage of the container 200 that is not filled with the fluid 214 is referred to as the headspace 212. For example, the container 200 may store 90% liquid water or an aqueous solution (i.e., a solution with water as the primary solvent) and 10% atmospheric or other gases. Some portion of the headspace 212 is allowed to adjust during filling and discharging operations as well as during freezing and thawing of the fluid 214 within the container 200.

Figure 3:
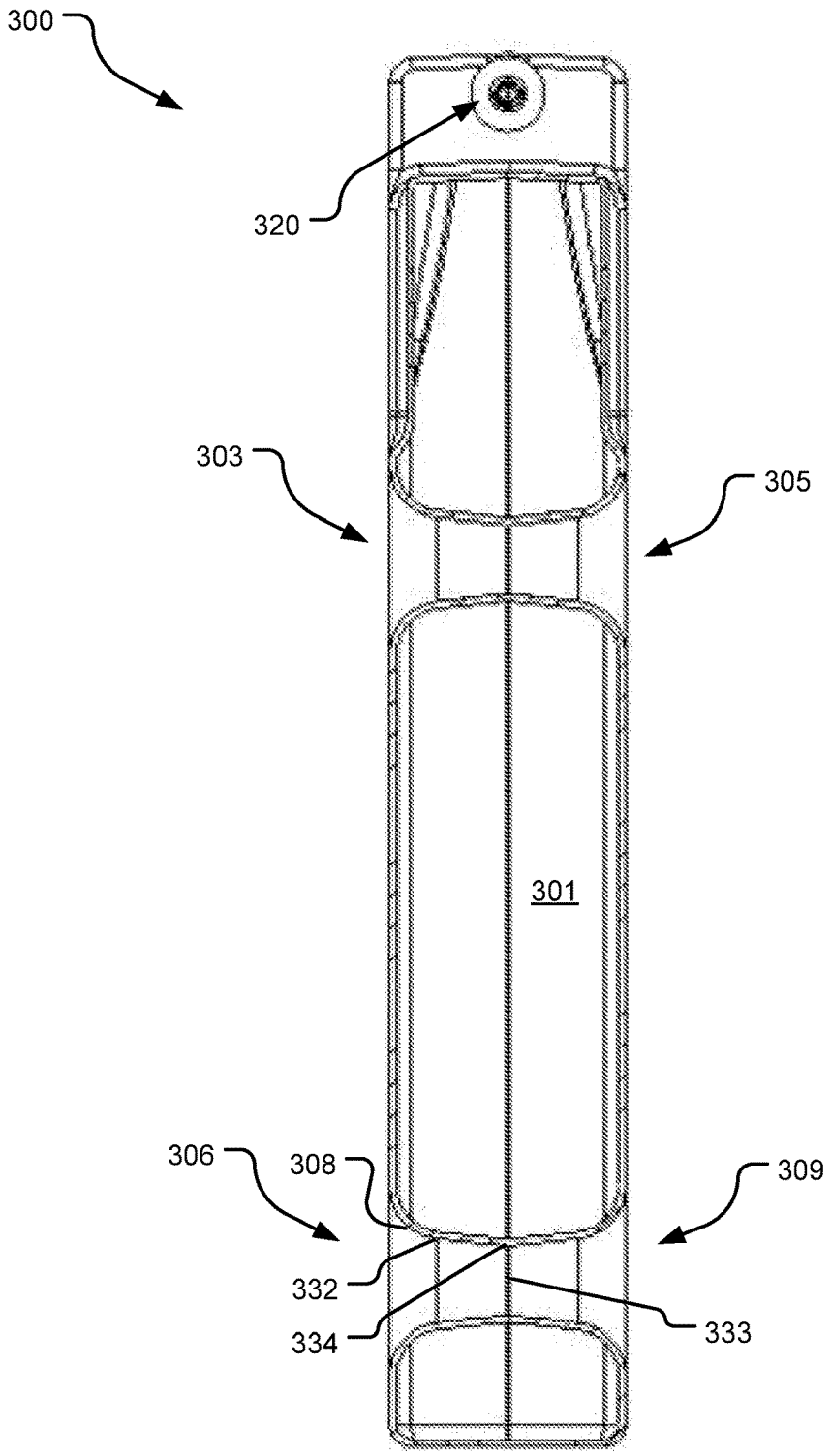
FIG. 3 is a cross-sectional elevation view of the example phase-change accommodating rigid fluid container of FIG. 2 taken at section A-A.

FIG. 3 is a cross-sectional elevation view of the example phase-change accommodating rigid fluid container 200 of FIG. 2 (here, container 300) taken at section A-A. The container 300 includes a variety of features discussed in detail herein that protect the container 300 from phase changes of a fluid stored therein. The container 300 includes a body 301 that is depicted as generally a rectangular box, but may be another volume-enclosing shape or combination of shapes with one or more of the features described herein.

The container 300 includes an array of recesses 303, 305, 306, 309 in the body 301. In various implementations, the recesses are arranged in matched pairs. For example, recesses 303, 305 are a matched pair of recesses in opposing sides of the container 300. Similarly, recesses 306, 309 are a matched pair of recesses in opposing sides of the container 300. The interior of each of the recesses is fully closed such that the container 300 is sealed from the atmosphere aside from input/output ports (e.g., input/outlet port 320). The container 300 may be physically secured and manipulated via the recesses.

While Section A-A illustrates four example cylindrical recesses in the container 300, the recesses may be any size, shape, or number appropriate for the intended movement or manipulation of the container 300. The recesses may also each have a countersink (e.g., countersink 308) surrounding the individual recesses. The countersink 308 may be straight or rounded in either a convex (as shown) or concave orientation. In other implementations, counterbores may be included in place of the depicted rounded countersinks.

The countersinks may increase localized stiffness and/or rigidity at the recesses and may also serve to guide manipulation hardware to the recesses when the manipulation hardware is interfaced with the container 300, and may serve to recess a portion of the manipulation hardware within the surrounding body 301. The countersinks may also serve to aid alignment with the manipulation hardware that may be imprecisely directed at the recesses (i.e., a self-centering feature).

Further, each recess may have a draft angle that narrows the recess toward a center of the container. For example, recess 306 has a countersink 308. At a base of the countersink 308, the recess 306 has recess diameter 332. The recess 306 has a further draft angle that concentrically narrows the recess 306 to recess diameter 334, which is less than recess diameter 332 by virtue of the draft angle. The recess diameter 334 exists at a center of the overall width of the container 300, with the draft angle narrowing the recess diameter from recess diameter 332 to recess diameter 334 from each side of the container 300 in a mirror image, as shown. In other implementations, the draft angle may extend through the entire width of the container 300 and thus the recess diameters 332, 334 exist at opposing surfaces of the container body 301. In various implementations, the draft angle aids in manufacturing of the container 300.

The recesses may not extend completely through the container body 301, and thus have a corresponding base structure (e.g., base structure 333). In some implementations, the base structure is shared between matched pairs of recesses. In other implementations, each recess has its own base structure distinct from the base structure of an opposing recess. In still other implementations, the recesses extend entirely through the container body 301, thus linking matched pairs of recesses through the container body 301.

Figure 4:
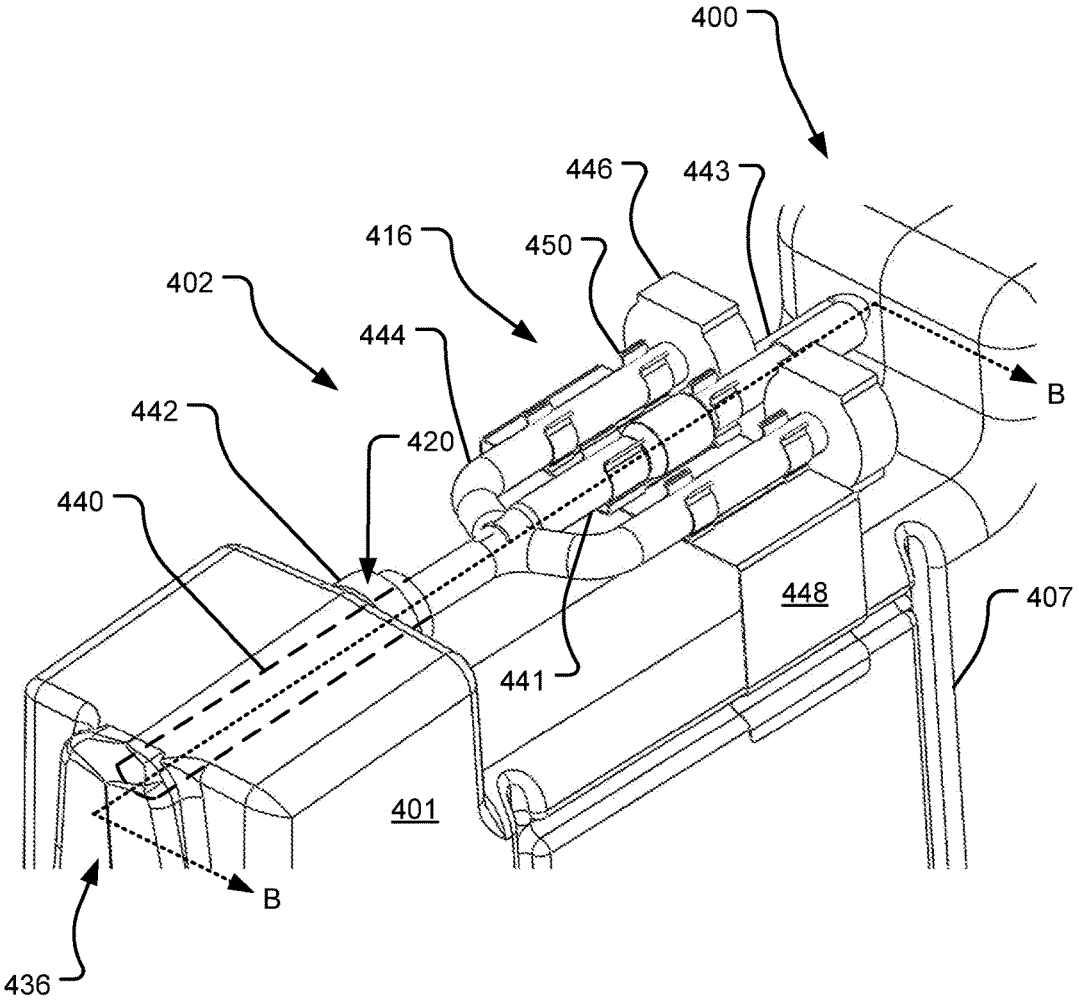
FIG. 4 is a detail perspective view of an example input/output assembly for a phase-change accommodating rigid fluid container.

FIG. 4 is a detail perspective view of an example input/output assembly 402 for a phase-change accommodating rigid fluid container 400. The container 400 includes a variety of features discussed in detail herein that protect the container 400 from phase changes of a fluid stored therein. The container 400 includes a body 401 that may be any volume-enclosing shape or combination of shapes with one or more of the features described herein.

The input/output assembly 402 is used for filling and discharging the container 400. A second similar input/output assembly (not shown) may also be included in the container 400 as shown in FIGS. 1 and 2. The input/output assembly 402 may also be used as a vent, which provides fluidic communication with the atmosphere and allows fluid to be added and removed from the container 400 and the fluid within the container 400 to freeze and thaw without building pressure within the container 400 (i.e., pressure equalization between the container 400 and atmospheric pressure).

The input/output assembly 402 includes an input/output port 420, through which a straw 440 extends to a point in close proximity to a bottom of a trough 436. A second similar trough (not shown) may also be included in the container 400 as shown in FIGS. 1 and 2. For example, when the input/output assembly 402 is used to drain the fluid from the container 400, the container 400 may be rotated such that the trough 436 is oriented at the bottom of the container 400 (see e.g., FIG. 11). Gravity forces the fluid toward the trough 436 and the trough 436 serves to funnel the fluid to a point located at the very bottom of the container 400 where the straw 440 is utilized by the input/output assembly 402 to withdraw the maximum amount of fluid from the container 400 with a minimum amount of waste fluid that remains unobtainable.

Figure 5:
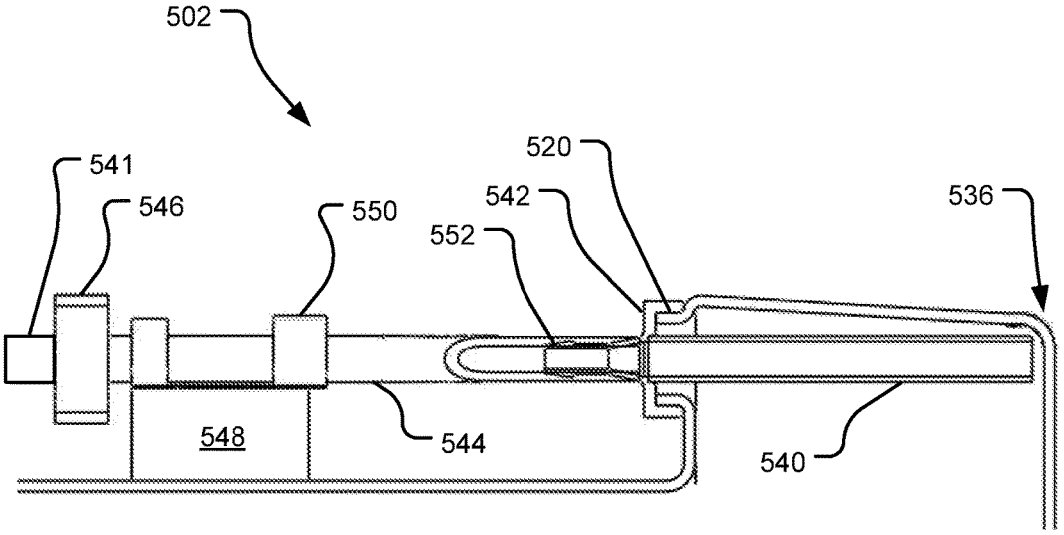
FIG. 5 is a cross-sectional elevation view of the example input/output assembly of FIG. 4 taken at section B-B.

The straw 440 extends out of the input/output port 420 and terminates with a barb (not shown, see e.g., barb 552 of FIG. 5). A cap 442 secures the straw 440 to the container 400 and seals the straw 440 against the input/output port 420. The cap 442 may be screwed or pressed on depending on the desired implementation. Further, the cap 442 may be removably attached or permanently affixed to the input/output port 420 and/or the straw 440.

A tube 444 is attached to the barb and extends away from the input/output port 420. The tube 444 is depicted with a y-configuration that splits access to the input/output port 420 into two separate tube sections that each terminate distal to the input/output port 420. In various implementations, the tube 444 may be silicone, rubber, or plastic in construction, depending on the intended use of the container 400. In other implementations, the tube 444 lacks the depicted y-configuration and merely terminates with a single end distal from the input/output port 420.

The distal ends of the tube 444 are each capped with a connector (e.g., an aseptic connector 446) that interfaces with equipment intended to withdraw the fluid from the container 400. In some implementations, the connectors are merely removable caps on the tube 444 that prevent the fluid from inadvertently leaking from the container 400. Still further, the connectors may not be airtight so that atmospheric air and/or fluid vapor is permitted to enter and exit the container 400 as the fluid changes phase (and thus volume) within the container 400.

The container 400 still further includes an input/output recess 416 that recesses the input/output assembly 402 into the body 401 to help protect against impact damage during manipulation of the container 400 or manipulation of equipment or other objects in close proximity to the container 400. A second similar input/output recess (not shown) may also be included in the container 400 as shown in FIGS. 1 and 2. Recessing the input/output assembly 402 increases the likelihood that an impact sustained by the container 400 is absorbed by the body 401 rather than the input/output assembly 402 itself.

The container 400 also includes stiffening ribs (e.g., rib 407) that provide additional stiffness to the sidewalls of the container 400. The stiffening ribs are formed channels in the body 401 of the container 400 that may protrude inward relative to the surrounding body 401 (as shown herein), or protrude outward relative to the surrounding body 401. Further, the stiffening ribs approach the recesses, but stop short of connecting the recesses. Still further, the stiffening ribs may be used to further reinforce the input/output recess 416 as shown. In other implementations, the stiffening ribs connect the recesses.

The input/output assembly 402 further includes a retainer bracket 448 that includes clips (e.g., clip 450) that secure the tube 444 and connectors within the input/output recess 416. More specifically, the retainer bracket 448 clips onto stiffening ribs that run on opposing sides of the container 400 and adjacent the input/output recess 416, as shown. In other implementations, the retainer bracket 448 may be otherwise mechanically or adhesively fastened to the body 401 of the container 400. The clips are secured to the retainer bracket 448 and clip onto the tube 444 to hold the tube 444 in place while the input/output assembly 402 is not in use. A user may remove the tube 444 from the clips as needed to utilize the connectors to withdraw fluid from the container 400 or add fluid to the container 400. In various implementations, the retainer bracket 448 and associated clips are of a metal or plastic construction.

Some of the clips may also be used to secure a sample (e.g., a tailgate sample 441) of the fluid stored within the container 400 for testing and/or overall container 400 content validation purposes. More specifically, the tailgate sample 441 is a closed container separate from the container 400 that stores a sample of the fluid stored within the container 400. The tailgate sample 441 may also include a sample port 443 that may be secured to one of the caps that facilitates access to the tailgate sample 441.

FIG. 5 is a cross-sectional elevation view of the example input/output assembly 402 of FIG. 4 (here, input/output assembly 502) taken at section B-B. The input/output assembly 502 may be used to fill, discharge, and/or vent an associated container (see e.g., container 400 of FIG. 4), while permitting the container to freeze and thaw without building pressure within the container.

The input/output assembly 502 includes an input/output port 520, through which a straw 540 extends to a point in close proximity to a bottom of a trough 536. In other implementations, the straw 540 turns approximately 90 degrees at the bottom of the trough 536 so that the end of the straw 540 runs generally parallel to the trough 536. This may reduce turbulence within the trough 536 when fluid is added or removed from the container via the straw 540. The straw 540 extends out of the input/output port 520 and terminates with a barb 552. A cap 542 secures the straw 540 to the container and seals the straw 540 against the input/output port 520. A tube 544 is attached to the barb 552 and extends away from the input/output port 520. A distal end of the tube 544 is capped with connector 546 that interfaces with equipment intended to withdraw the fluid from the container.

The input/output assembly 502 further includes a retainer bracket 548 that includes clips (e.g., clip 550) that secure the tube 544 and connector 546. More specifically, the clips are secured to the retainer bracket 548 and clip onto the tube 544 to hold the tube 544 in place while the input/output assembly 502 is not in use. Some of the clips may also be used to secure a sample (e.g., a tailgate sample 541) of the fluid stored within the container for testing and/or verification purposes.

Figure 6:
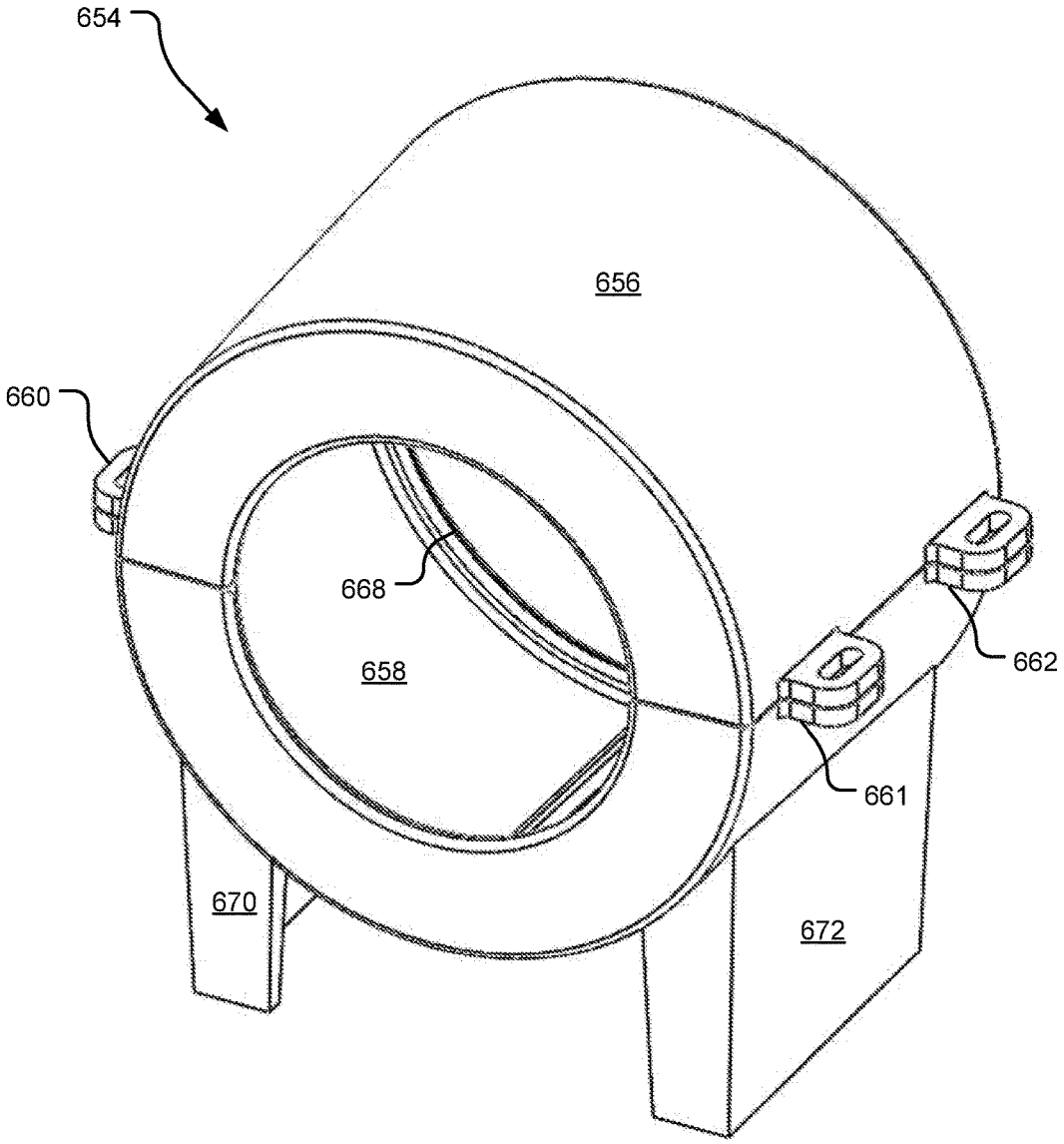
FIG. 6 is a perspective view of an example locking mechanism for an input/output assembly of a phase-change accommodating rigid fluid container.
Figure 7:
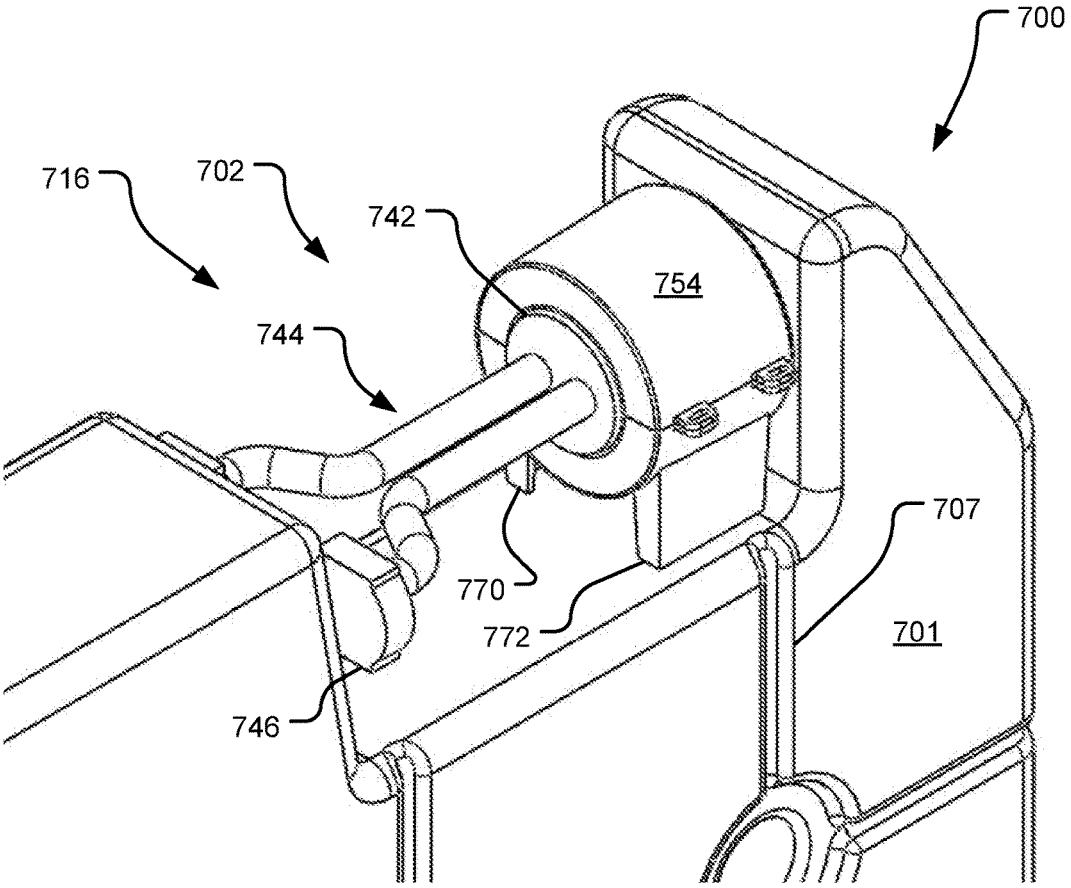
FIG. 7 is a detail perspective view of an example locking mechanism installed on an input/output assembly for a phase-change accommodating rigid fluid container.

FIG. 6 is a perspective view of an example locking mechanism 654 for an input/output assembly (not shown, see e.g., input/output assembly 702 of FIG. 7) of a phase-change accommodating rigid fluid container (not shown, see e.g., container 700 of FIG. 7). The locking mechanism 654 is used in conjunction with a cap (not shown, see e.g., cap 742 of FIG. 7) to secure the cap and prevent it from inadvertently loosening. Inadvertent loosening may occur with pressure and temperature changes, fluid phase changes, or mechanical force, for example. In some implementations, the locking mechanism 654 may be used to show evidence of unauthorized tampering with a corresponding container.

The locking mechanism 654 includes two halves 656, 658 in a clamshell arrangement, with pass-throughs 660, 661, 662 acting to selectively connect the halves 656, 658 together. In other implementations, a hinge (e.g., a live hinge, not shown) may fixedly connect one side of the two halves 656, 658 together, while one or more of the pass-throughs 660, 661, 662 selectively connect the other side of the two halves 656, 658 together. For example, clasps (not shown) may pass through the pass throughs 660, 661, 662 to selectively secure the two halves 656, 658 together. In some implementations, the clasps extending through the pass throughs 660, 661, 662 creates a tamper-proof connection that would reveal any unauthorized access to the cap secured by the locking mechanism 654.

The halves 656, 658 surround and partially enclose the cap. In other implementations, protrusions (not shown) from the cap interface with a scalloped or otherwise contoured inner pattern (not shown) of the locking mechanism 654 to prevent the cap from rotating with respect to the locking mechanism 654 when the locking mechanism 654 is installed on the cap. Further, the locking mechanism 654 includes a rear flange 668 that prevents the locking mechanism 654 from sliding off the cap. Still further, the locking mechanism 654 includes mechanical stops 670, 672 that engage with an adjacent fluid container surface (see e.g., fluid container 700 of FIG. 7) and prevent rotation of the locking mechanism 654 (and the cap) with respect to the fluid container.

FIG. 7 is a detail perspective view of an example locking mechanism 754 installed on an input/output assembly 702 for a phase-change accommodating rigid fluid container 700. The container 700 includes a variety of features discussed in detail herein that protect the container 700 from phase changes of a fluid stored therein. The container 700 includes a body 701 that may be any volume-enclosing shape or combination of shapes with one or more of the features described herein.

The input/output assembly 702 is used for filling and discharging the container 700. A second similar input/output assembly (not shown) may also be included in the container 700 as shown in FIGS. 1 and 2. The input/output assembly 702 may also be used as a vent, which provides fluidic communication with atmosphere and allows fluid to be added and removed from the container 700 and the fluid within the container 700 to freeze and thaw without building pressure within the container 700.

The input/output assembly 702 includes an input/output port (not shown), through which fluid is added and/or removed from the container 700. A pair of tubes 744 extend from the input/output port and are secured to the input/output port via a cap 742. In various implementations, there may be greater or fewer tubes than the depicted two tubes extending from the input/output port. The cap 742 screws onto the input/output port to secure the tubes 744 to the container 700 and seal the tubes 744 to the input/output port. In some implementations, the cap 742 includes protrusions (not shown) that match and selectively interface with the locking mechanism 754 preventing the cap 742 from rotating with reference to the locking mechanism 754.

As described above with regard to FIG. 6, the locking mechanism 754 is clasped around the cap 742 to secure the cap 742 in place. The locking mechanism 754 includes a rear flange (not shown, see e.g., rear flange 668 of FIG. 6) that prevents the locking mechanism 754 from sliding off the cap 742. Still further, the locking mechanism 754 includes mechanical stops 770, 772 that engage with the adjacent body 701 and prevent rotation of the locking mechanism 754 and the cap with respect to the fluid container 700.

The distal ends of the tubes 744 are each capped with a connector (e.g., an aseptic connector 746) that interfaces with equipment intended to withdraw the fluid from the container 700. In some implementations, the connectors are merely removable caps on the tubes 744 that prevent the fluid from inadvertently leaking from the container 700. Still further, the connectors may not be airtight so that atmospheric air and/or fluid vapor is permitted to enter and exit the container 700 as the fluid changes phase (and thus volume) within the container 700.

The container 700 still further includes an input/output recess 716 that recesses the input/output assembly 702 into the body 701 to help protect against impact damage during manipulation of the container 700 or manipulation of equipment or other objects in close proximity to the container 700. A second similar input/output recess (not shown) may also be included in the container 700 as shown in FIGS. 1 and 2.

The container 700 also includes stiffening ribs (e.g., rib 707) that provide additional stiffness to the sidewalls of the container 700. The stiffening ribs are formed channels in the body 701 of the container 700 that may protrude inward relative to the surrounding body 701 (as shown herein), or protrude outward relative to the surrounding body 701. Further, the stiffening ribs may be used to further reinforce the input/output recess 716.

Figure 8:
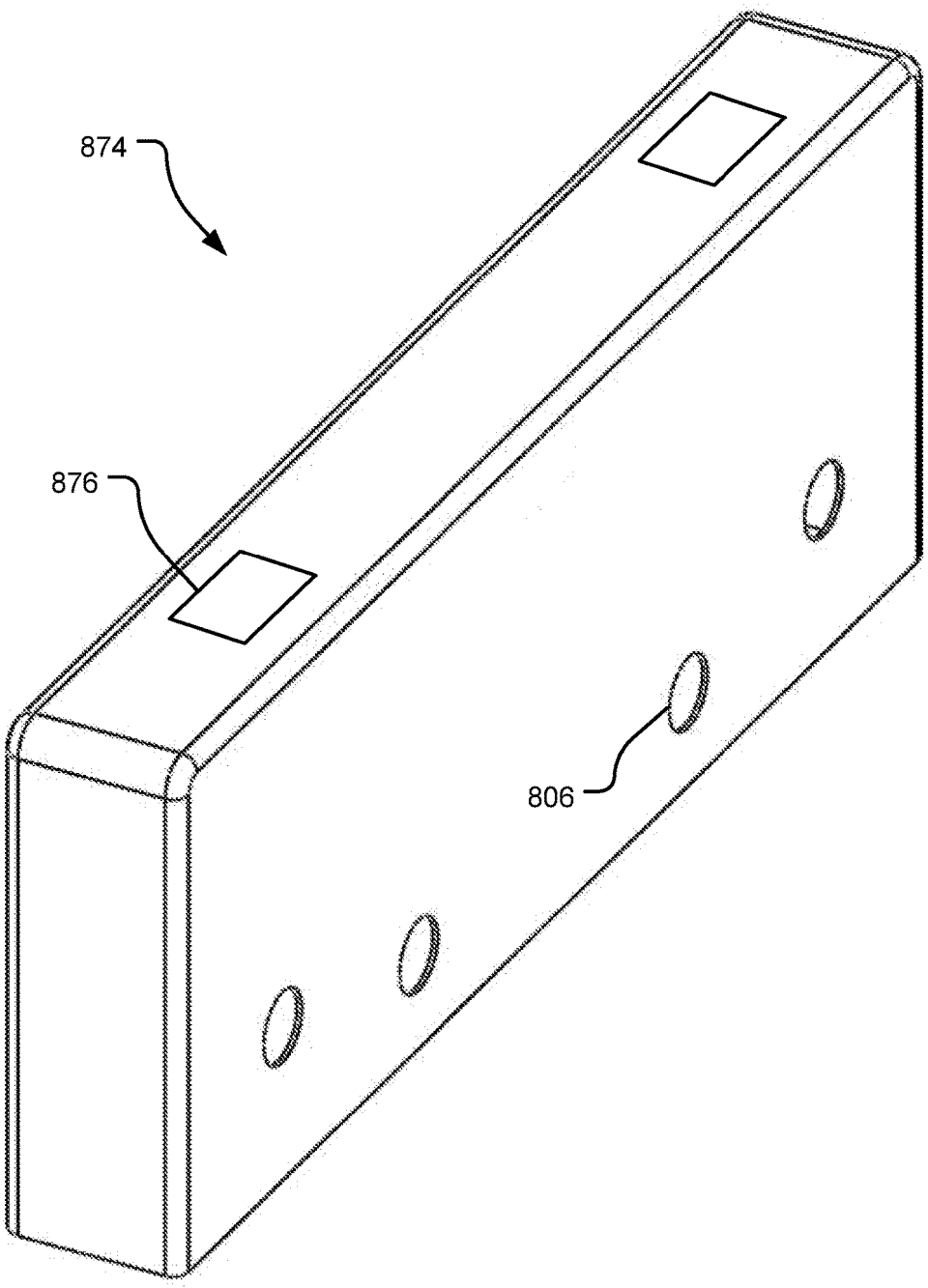
FIG. 8 is a perspective view of an example shroud for a phase-change accommodating rigid fluid container.
Figure 9:
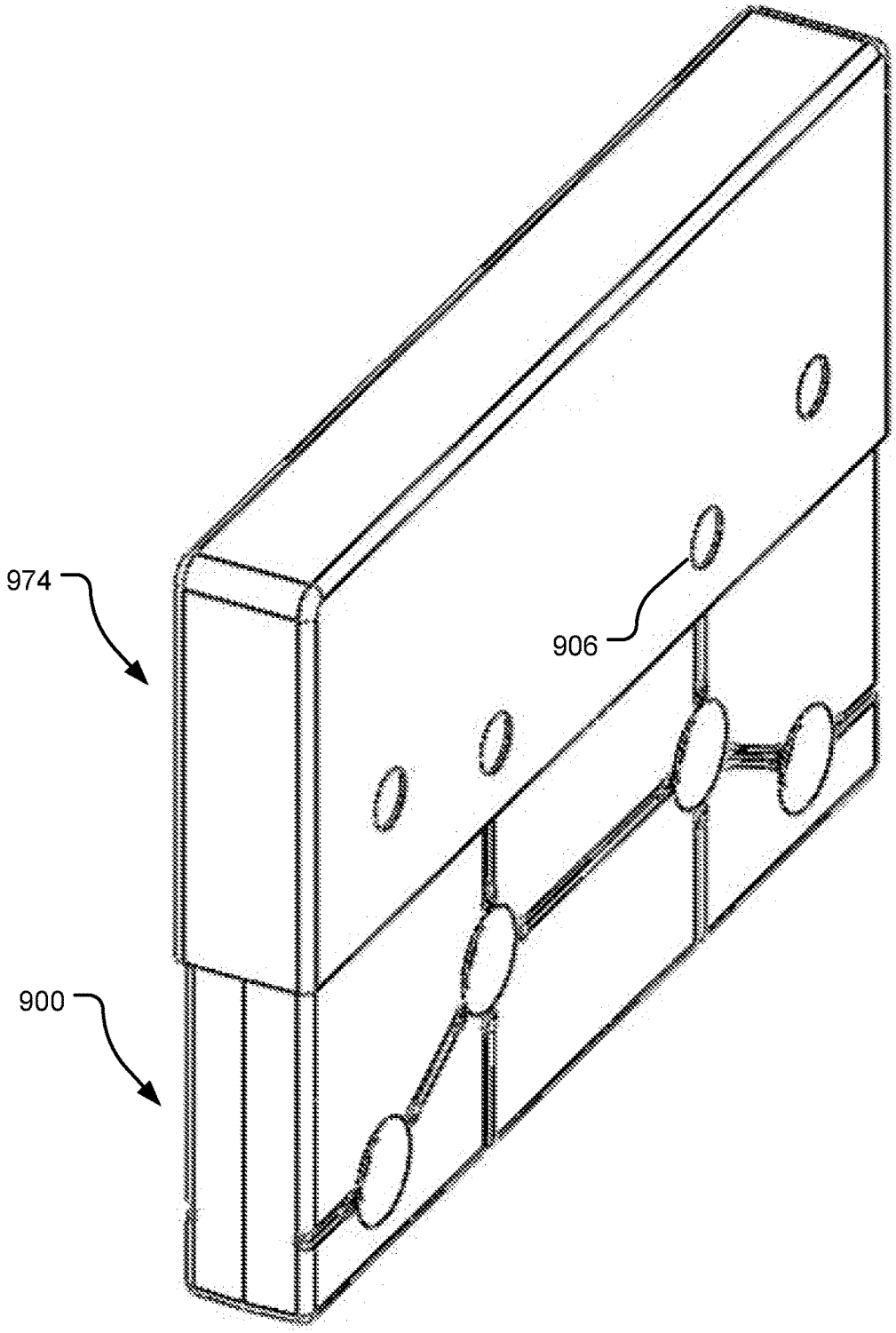
FIG. 9 is a perspective view of an example shroud utilized on a phase-change accommodating rigid fluid container.

FIG. 8 is a perspective view of an example shroud 874 for a phase-change accommodating rigid fluid container (not shown, see e.g., container 900 of FIG. 9). The shroud 874 matches a portion of the container to be protected and is configured to slip onto and protect one or more features of the container. As a result, the shroud 874 may have a similar shape, with an interior profile that closely matches an exterior profile of the container to permit a slip fit between the shroud 874 and the container.

Further, the shroud 874 has an opening that permits the shroud 874 to be slipped onto the container (e.g., a bottom plan of the depicted shroud 874). The shroud 874 includes an array of pass-through apertures (e.g., aperture 806) that correspond in size and location to recesses in the container when the shroud 874 is in place on the container. As a result, the recesses in the container are still accessible whether or not the shroud 874 is in place on the container. In some implementations, the shroud 874 includes one or more access panels (e.g., panel 876) that permit access to protected features of the container (e.g., input/output assemblies) without removing the shroud 874. In various implementations, the access panels may be open apertures, hinged doors, slip-fit panels, etc.

FIG. 9 is a perspective view of an example shroud 974 utilized on a phase-change accommodating rigid fluid container 900. The shroud 974 matches a top portion of the container 900 and is configured to slip over the top of the container 900 and protect one or more features of the container (e.g., input/output assemblies 102, 104 of FIG. 1). As a result, the shroud 974 may have a similar shape, with an interior profile that closely matches an exterior profile of the container 900 to permit a slip fit between the shroud 974 and the container 900.

Further, the shroud 974 has an opening that permits the shroud 974 to be slipped onto the top of the container 900 (e.g., a bottom plan of the depicted shroud 974). The shroud 974 includes an array of pass-through apertures (e.g., aperture 906) that correspond in size and location to recesses in the container 900 when the shroud 974 is in place on the container 900. As a result, the recesses in the container 900 are still accessible whether or not the shroud 974 is in place on the container 900. In various implementations, matching apertures in the shroud 974 and the container 900 may be used to lock the shroud 974 and the container 900 by passing a security cable loop there through.

Figure 10:
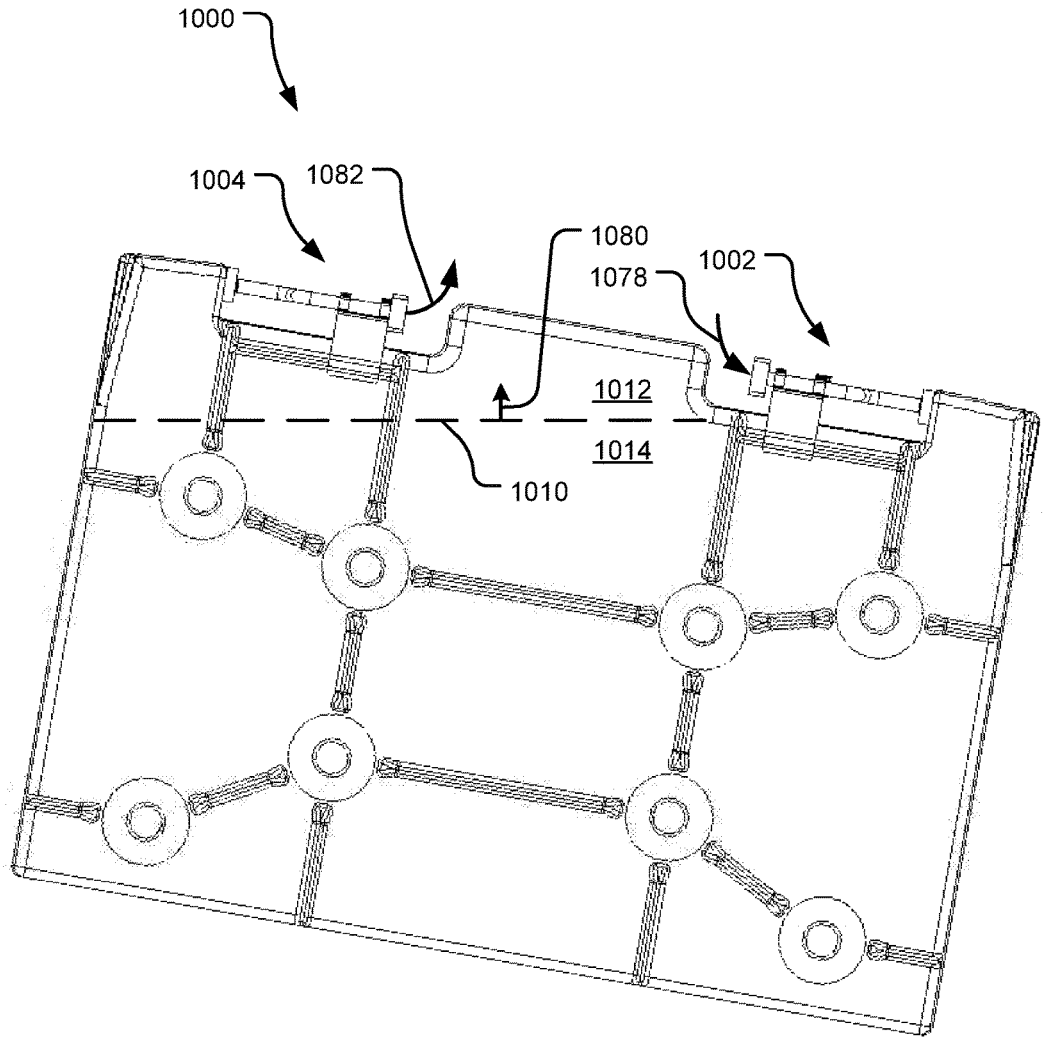
FIG. 10 is an elevation view of an example phase-change accommodating rigid fluid container in a fill orientation.

FIG. 10 is an elevation view of an example phase-change accommodating rigid fluid container 1000 in a fill orientation. The container 1000 includes a variety of features discussed in detail herein that protect the container 1000 from phase changes of a fluid 1014 existing below fluid line 1010. Headspace 1012 exists above the fluid line 1010.

The container 1000 in the fill orientation is rotated 10 degrees clockwise as compared to the freeze/thaw orientation of container 200 of FIG. 2. Input/output assembly 1002 is utilized as a fluid inlet and input/output assembly 1004 is utilized as a vent. In various implementations, the degree of rotation to achieve the fill orientation may vary so long as the venting input/output assembly (here, input/output assembly 1004) remains above the fluid line 1010. In other implementations, the fill orientation is rotated counterclockwise as compared to the freeze/thaw orientation of container 200 of FIG. 2 and the input/output assembly 1002 is utilized as the vent and remains above the fluid line 1010, while the input/output assembly 1004 is utilized as the fluid inlet.

The fluid 1014 fills the container 1000 via the input/output assembly 1002 as illustrated by arrow 1078. This causes the fluid line 1010 to rise, as illustrated by arrow 1080 and fluid vapor to exit the container 1010 via the input/output assembly 1004, as illustrated by arrow 1082. More generally, as the container 1000 is filled with the fluid 1014 via the input/output assembly 1002, the fluid level 1010 rises and the headspace 1012 shrinks. Headspace gas that the fluid 1014 displaces as it fills the container 1000 is discharged from the container 1000 via the input/output assembly 1004. In some implementations, the fluid 1014 is not allowed to completely fill the container 1000, thus always leaving some headspace 1012 to accommodate freeze expansion within the container 1000.

Figure 11:
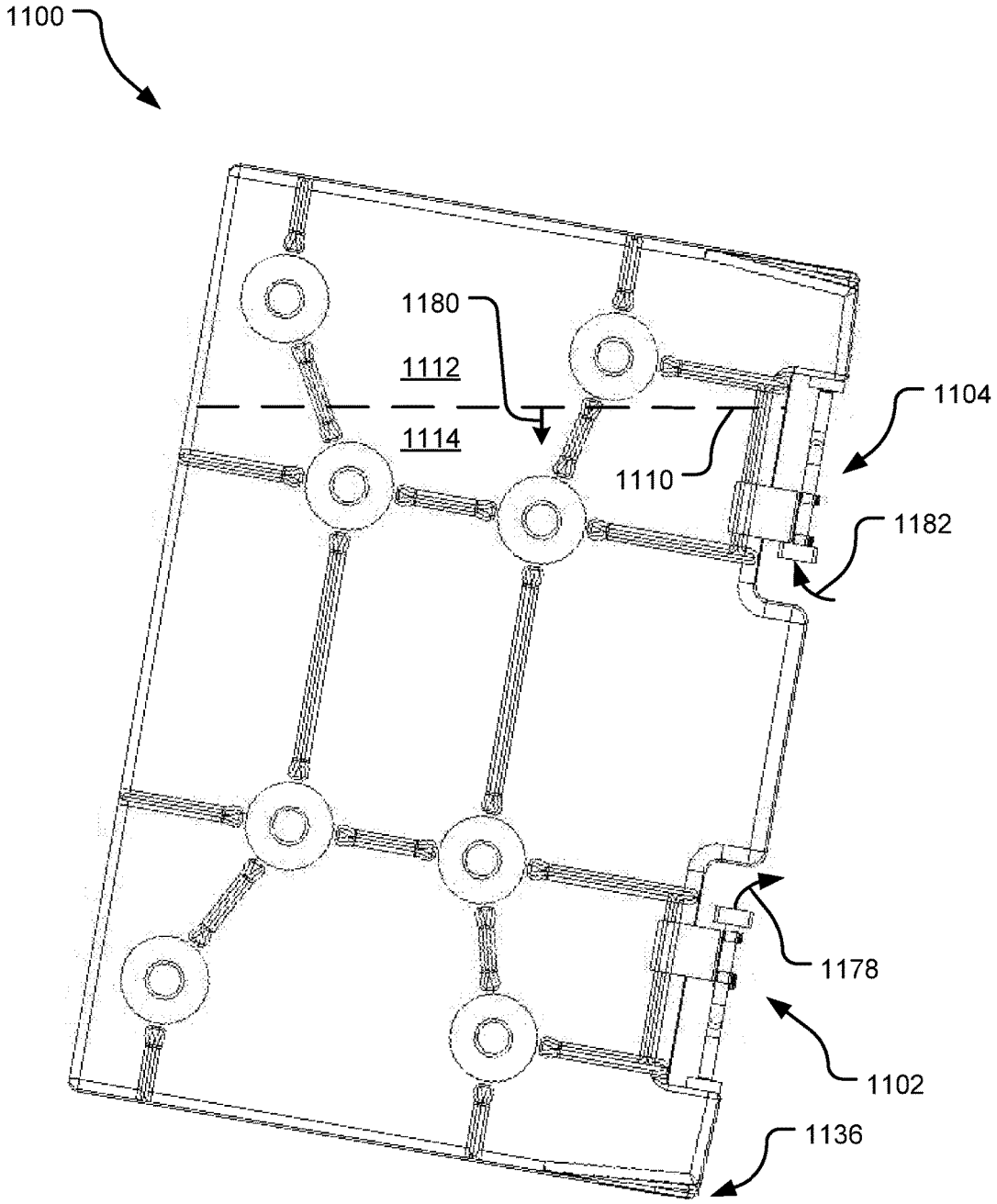
FIG. 11 is an elevation view of an example phase-change accommodating rigid fluid container in a discharge orientation.

FIG. 11 is an elevation view of an example phase-change accommodating rigid fluid container 1100 in a discharge orientation. The container 1100 includes a variety of features discussed in detail herein that protect the container 1100 from phase changes of a fluid 1114 existing below fluid line 1110. Headspace 1112 exists above the fluid line 1110.

The container 1100 in the discharge orientation is rotated 100 degrees clockwise as compared to the freeze/thaw orientation of container 200 of FIG. 2. Input/output assembly 1102 is utilized as a fluid exit and input/output assembly 1104 is utilized as a vent. In various implementations, the degree of rotation to achieve the discharge orientation may vary so long as the fluid exit input/output assembly (here, input/output assembly 1102) is oriented near the bottom of the container 1100. Further, a maximum amount of the fluid may be discharged from the container 1100 when the container 1100 is oriented with a fluid exit trough 1136 at or near the bottom of the container 1100, as shown. In other implementations, the discharge orientation is rotated counterclockwise as compared to the freeze/thaw orientation of container 200 of FIG. 2 and the input/output assembly 1102 is utilized as the vent, while the input/output assembly 1104 is utilized as the fluid exit.

The fluid 1114 exits the container 1100 via the input/output assembly 1102 as illustrated by arrow 1178. This causes the fluid line 1110 to drop, as illustrated by arrow 1180, and atmospheric air or other gases to enter the container 1110 via the input/output assembly 1104, as illustrated by arrow 1182. More generally, as the fluid 1114 is drained from the container 1100 via the input/output assembly 1102, the fluid level 1110 drops and the headspace 1112 shrinks. Atmospheric air or other gases enter the container 1100 via the input/output assembly 1104 replace the fluid 1114 as it is discharged from the container 1100.

Figure 12:
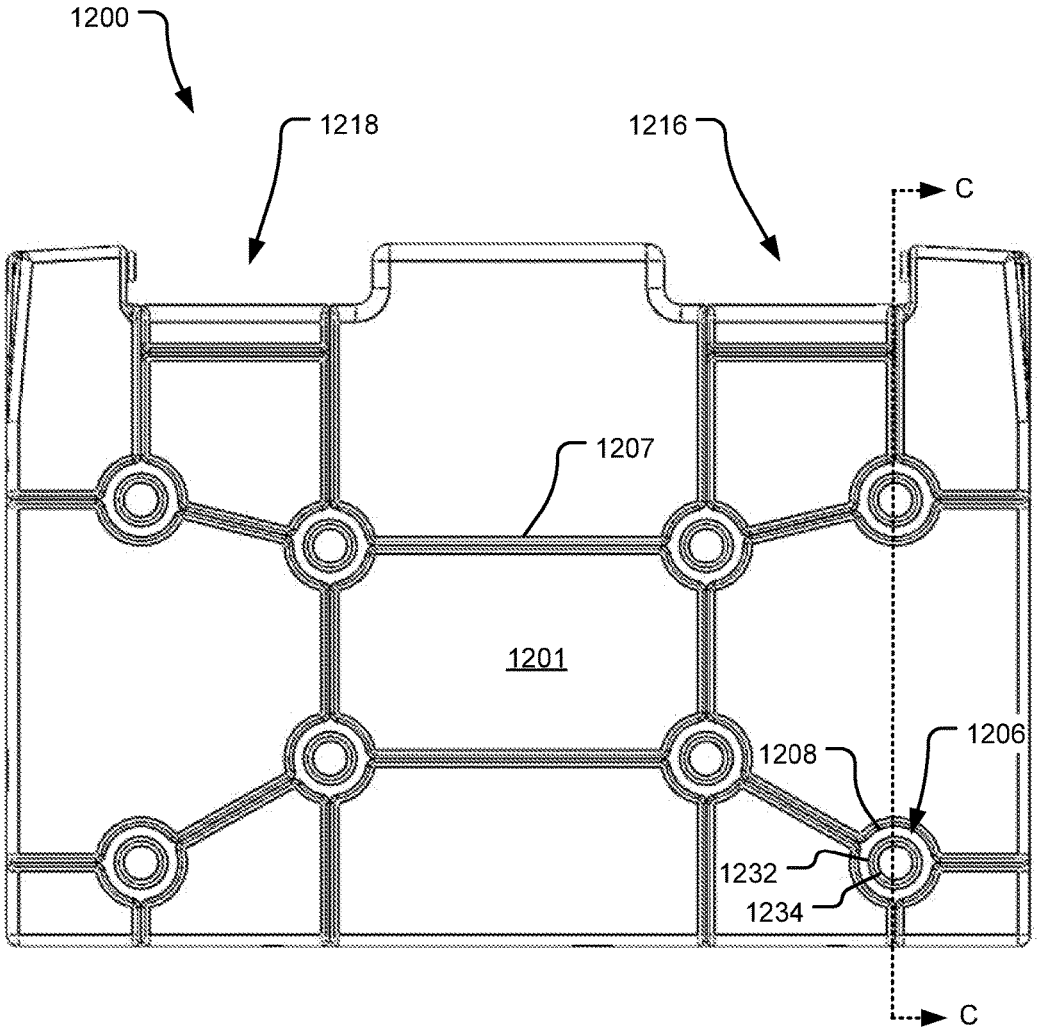
FIG. 12 is an elevation view of another example phase-change accommodating rigid fluid container.

FIG. 12 is an elevation view of another example phase-change accommodating rigid fluid container 1200 in a freeze/thaw (or phase-change) orientation. The container 1200 includes a body 1201 that is depicted as generally a rectangular box, but may be another volume-enclosing shape or combination of shapes with one or more of the features described herein. The container 1200 includes input/output recesses 1216, 1218 that recess the input/output assemblies (not shown) into the body 1201 to help protect against impact damage during manipulation of the container 1200 or manipulation of equipment or other objects in close proximity to the container 1200.

The container 1200 also includes an array of manipulation recesses (e.g., recess 1206) in the body 1201. The interior of each of the recesses is fully closed such that the container 1200 is sealed from the atmosphere aside from the input/output assemblies. The container 1200 may be physically secured and manipulated via the recesses.

While eight cylindrical recesses are depicted in the container 1200, the recesses may be any size, shape, or number appropriate for the intended movement or manipulation of the container 1200. The recesses may also each include a countersink or counterbore (e.g., counterbore 1208) surrounding the individual recesses. The countersink or counterbore may increase localized stiffness and/or rigidity at the recesses and may also serve to guide manipulation hardware to the recesses when the manipulation hardware is interfaced with the container 1200. The countersink or counterbore may also serve to recess a portion of the manipulation hardware within the surrounding body 1201. In implementations that utilize countersinks at each recess, the countersinks may serve to aid alignment with the manipulation hardware that may be imprecisely directed at the recesses (i.e., a self-centering feature).

Further, each recess may have one or more draft angles that narrow the recess toward a center of the container 1200. For example, recess 1206 has a counterbore 1208. At a base of the counterbore 1208, the recess 1206 has recess diameter 1232. The recess 1206 has a further draft angle that concentrically narrows the recess 1206 to recess diameter 1234, which is less than recess diameter 1232 by virtue of the draft angle. In various implementations, the draft angle may vary from 1-10 degrees. In addition, the recess diameter 1234 may exist at a center of the overall width of the container 1200, with the draft angle narrowing the recess diameter from recess diameter 1232 to recess diameter 1234 from each side of the container 1200 in a mirror image (only one side of the container 1200 is shown in FIG. 12). In other implementations, the draft angle may extend through the entire width of the container 1200 and thus the recess diameters 1232, 1234 exist at opposing surfaces of the container body 1201. In various implementations, the draft angle aids in manufacturing the container 1200. In other implementations, the recesses do not incorporate a draft angle. In addition, in some implementations, the recesses do not extend completely through the container body 1201 and are entirely counterbores or countersinks in the container body 1201.

The container 1200 also includes stiffening ribs (e.g., rib 1207) that provide additional stiffness to the sidewalls of the container 1200. The stiffening ribs are formed channels in the body 1201 of the container 1200 that may protrude inward relative to the surrounding body 1201 (as shown herein), or protrude outward relative to the surrounding body 1201. The stiffening ribs connect the recesses, which may provide additional strength to the recesses when they are used as lifting points. Use of the stiffening ribs to increase strength at the recesses may also increase localized stiffness and/or rigidity at the recesses. Further, the stiffening ribs may be used to further reinforce the input/output recesses 1216, 1218 as shown. In other implementations, the stiffening ribs approach the recesses, but stop short of connecting the recesses to preserve the structural integrity of the recesses and avoid introducing any rapid transitions that may lead to reduced thickness of material in some manufacturing processes.

In still other implementations, the stiffening ribs include flared ends (not shown) that provide smoother transitions to the surrounding body 1201 and connected recesses. As a result, the flared ends may reduce the occurrence of stress concentrations in the body 1201 and reduce localized thinning of material that would otherwise occur when manufacturing the container 1200 with more abrupt transitions.

Figure 13:
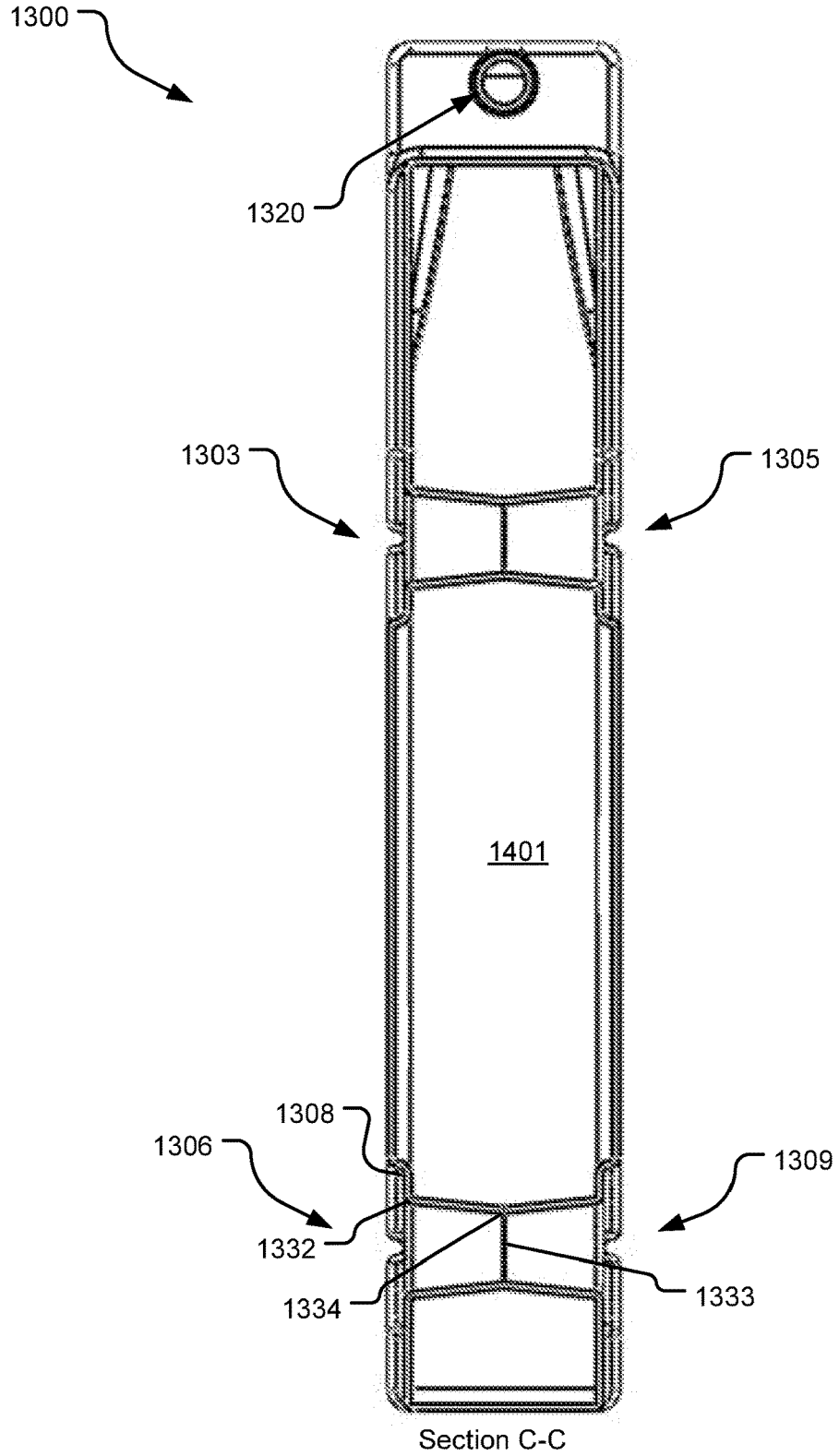
FIG. 13 is a cross-sectional elevation view of the example phase-change accommodating rigid fluid container of FIG. 12 taken at section C-C.

FIG. 13 is a cross-sectional elevation view of the example phase-change accommodating rigid fluid container 1200 of FIG. 12 (here, container 1300) taken at section C-C. The container 1300 includes a variety of features discussed in detail herein that protect the container 1300 from phase changes of a fluid stored therein. The container 1300 includes a body 1301 that is depicted as generally a rectangular box, but may be another volume-enclosing shape or combination of shapes with one or more of the features described herein.

The container 1300 includes an array of recesses 1303, 1305, 1306, 1309 in the body 1301. In various implementations, the recesses are arranged in matched pairs. For example, recesses 1303, 1305 are a matched pair of recesses in opposing sides of the container 1300. Similarly, recesses 1306, 1309 are a matched pair of recesses in opposing sides of the container 1300. The interior of each of the recesses is fully closed such that the container 1300 is sealed from the atmosphere aside from input/output ports (e.g., input/outlet port 1320). The container 1300 may be physically secured and manipulated via the recesses.

While Section C-C illustrates four example cylindrical recesses in the container 1300, the recesses may be any size, shape, or number appropriate for the intended movement or manipulation of the container 1300. The recesses may also each have a counterbore (e.g., counterbore 1308) surrounding the individual recesses. In other implementations, countersinks may be included in place of the depicted counterbores.

The counterbores may increase localized stiffness and/or rigidity at the recesses and may also serve to guide manipulation hardware to the recesses when the manipulation hardware is interfaced with the container 1300, and may serve to recess a portion of the manipulation hardware within the surrounding body 1301. The counterbores may also serve to aid alignment with the manipulation hardware that may be imprecisely directed at the recesses (i.e., a self-centering feature).

Further, each recess may have a draft angle that narrows the recess toward a center of the container. For example, recess 1306 has a counterbore 1308. At a base of the counterbore 1308, the recess 1306 has recess diameter 1332. The recess 1306 has a further draft angle that concentrically narrows the recess 1306 to recess diameter 1334, which is less than recess diameter 1332 by virtue of the draft angle. The recess diameter 1334 exists at a center of the overall width of the container 1300, with the draft angle narrowing the recess diameter from recess diameter 1332 to recess diameter 1334 from each side of the container 1300 in a mirror image, as shown. In other implementations, the draft angle may extend through the entire width of the container 1300 and thus the recess diameters 1332, 1334 exist at opposing surfaces of the container body 1301. In various implementations, the draft angle aids in manufacturing of the container 1300.

The recesses may not extend completely through the container body 1301, and thus have a corresponding base structure (e.g., base structure 1333). In some implementations, the base structure is shared between matched pairs of recesses. In other implementations, each recess has its own base structure distinct from the base structure of an opposing recess. In still other implementations, the recesses extend entirely through the container body 1301, thus linking matched pairs of recesses through the container body 1301.

Figure 14:
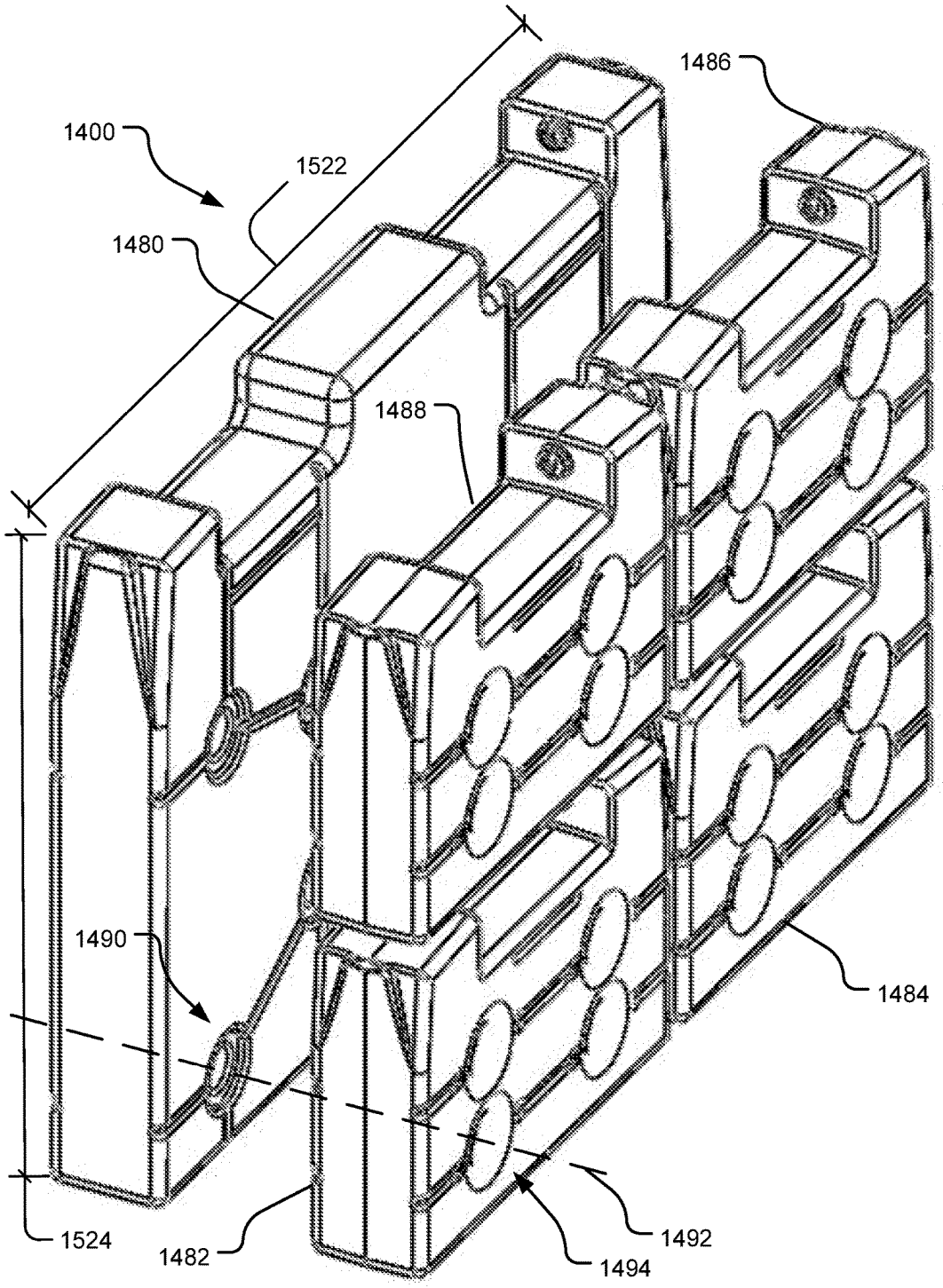
FIG. 14 is a perspective view of a stackable array of phase-change accommodating rigid fluid containers of varying size.

FIG. 14 is a perspective view of a stackable array 1400 of phase-change accommodating rigid fluid containers of varying size. A larger container 1480 (e.g., a 100 liter container) has a profile dimension that substantially matches an overall profile dimension of four smaller containers 1482, 1484, 1486, 1488 (e.g., four 20 liter containers). More specifically, the larger container 1480 has an exterior length 1422 and an exterior height 1424 that defines its profile dimension. The smaller containers 1482, 1484, 1486, 1488 each have smaller profile dimensions, but in combination have a profile dimension that substantially matches the profile dimension of the larger container 1480. As a result, multiple sizes of containers are able to be stacked adjacent to one another in similar space constraints.

Further, matched pairs of recesses in the large container (e.g., matched pair 1490) align with matched pairs of recesses in the smaller containers (e.g., matched pair 1494), as illustrated by dashed line 1492. As a result, manipulation hardware may engage the large container and smaller containers via the aligned matched pairs of recesses to physically manipulate the array of containers as a unit.

Figure 15:
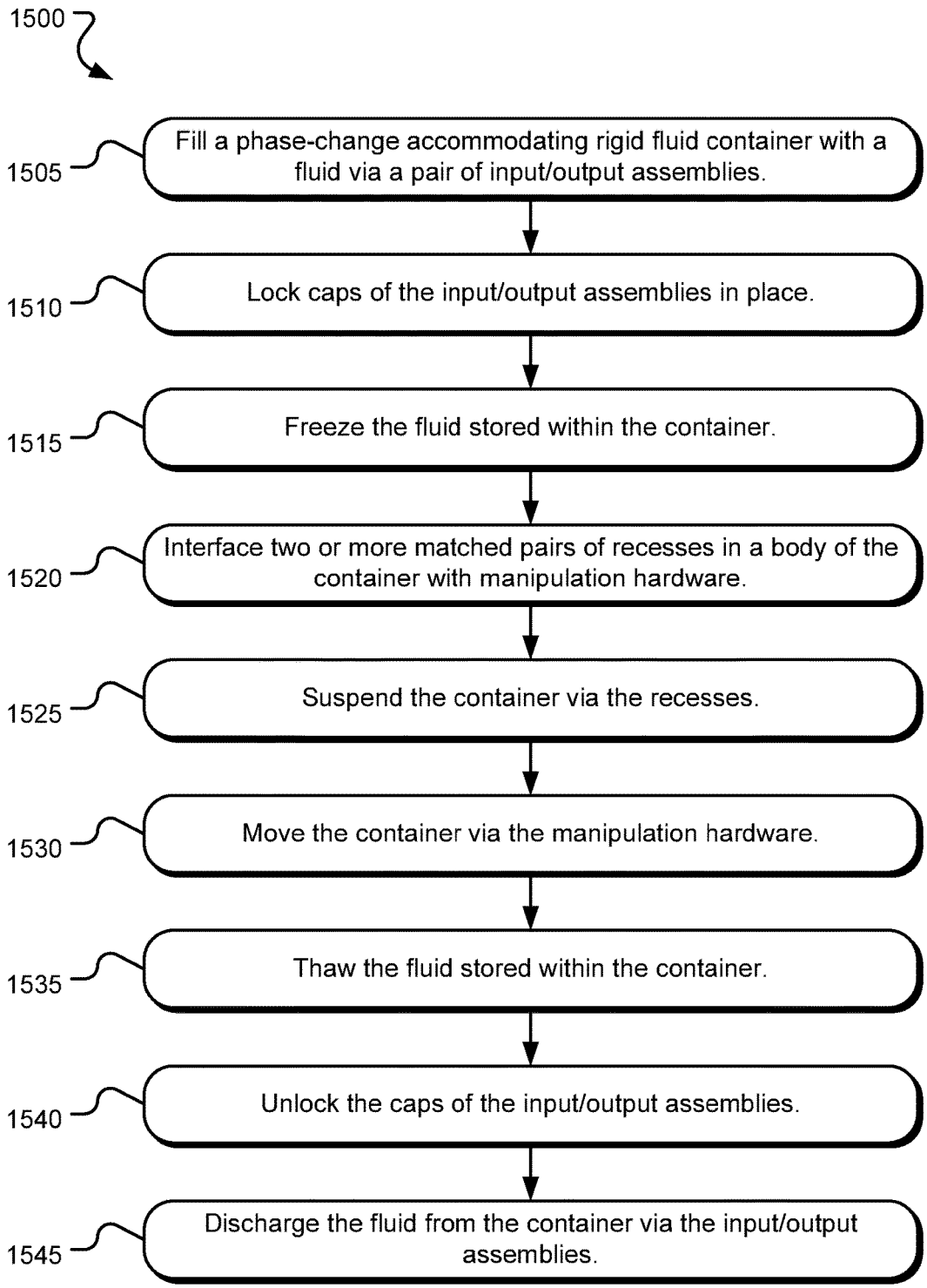
FIG. 15 illustrates example operations for using a phase-change accommodating rigid fluid container.

FIG. 15 illustrates example operations 1500 for using a phase-change accommodating rigid fluid container. A filling operation 1505 fills the container with a fluid via a pair of input/output assemblies. The container is oriented in a fill orientation, which places one of the input/output assemblies in a headspace of the container above another of the input/output assemblies. This allows the input/output assembly in the headspace to serve as a vent to atmosphere, thereby maintaining pressure equalization within the container to atmospheric pressure. More specifically, the vent provides an exit to atmosphere for gases that are displaced by the fluid introduced into the container. The other input/output assembly is used to introduce the fluid into the container. The container is filled at any desired fill state that maintains a minimum headspace volume to accommodate expected freeze expansion and thaw contraction.

A locking operation 1510 locks a cap of one or both of the input/output assemblies in place. The locking operation 1510 may utilize locking mechanisms that partially enclose the caps and prevents rotation of the caps with respect to the locking mechanisms and rotation of the locking mechanisms with respect to the container. In some implementations, the locking mechanisms prevent the caps from inadvertently unscrewing from the input/output assemblies. In other implementations, the locking mechanisms prevent unauthorized tampering or alerts to unauthorized tampering with the input/output assemblies. Still further, the locking operation 710 may be omitted where inadvertent or unauthorized unscrewing of the caps from the input/output assemblies is not of concern.

A freezing operation 1515 freezes the fluid stored within the container. The container is placed in a phase-change orientation during the freezing operation, which orients both of the input/output assemblies in a headspace of the container. Thus, any phase-change of the fluid does not impact the input/output assemblies, which may be susceptible to damage from the phase change. The aspect ratio (height/width and/or length/width) and other disclosed features of the container prevent the freezing operation 1515 from damaging the container.

An interfacing operation 1520 interfaces two or more matched pairs of recesses in a body of the container with manipulation hardware. The container includes the matched recesses to enable easy physical manipulation of the container. The matched pairs of recesses are oriented on opposing sides of the container and the manipulation hardware either extends through the recesses (in the event the pairs of recesses connect through the container) or pinches the container at the recesses to attach to the container.

A suspending operation 1525 suspends the container via the recesses. The manipulation hardware lifts the container via the recesses and the container is structurally configured such that it may be fully supported via the recesses. A moving operation 1530 moves the container to a new location and/or orientation. The manipulation hardware may be moved in concert to physically relocate the container. Further, the manipulation hardware may be moved with respect to itself to physically re-orient the container (e.g., to move from fill, phase-change, and discharge orientations).

A thawing operation 1535 thaws the frozen fluid stored within the container. In various implementations, the fluid within the container is not entirely frozen in operation 1515 and/or entirely thawed in operation 1535. The container is merely able to withstand full phase changes, should they occur. Still further, freezing operation 1515 and thawing operation 1535 may be repeated during performance of the operations 1500, for example, during transit of the container.

An unlocking operation 1540 unlocks the caps of the input/output assemblies. The unlocking operation 1540 is achieved by removing the locking mechanisms from the caps of the input/output assemblies. The unlocking operation 1540 may be omitted when the locking operation 1510 is omitted.

A discharging operation 1545 discharges the fluid from the container via the input/output assemblies. The container is oriented in a discharge orientation, which places a straw of one of the input/output assemblies at a low-point of the container. The other of the input/output assemblies is utilized as a vent, permitting pressure equalization gases (atmospheric air or other gases) into the container as the fluid is drained from the container, thereby maintaining pressure equalization within the container to atmospheric pressure. More specifically, the vent provides an entrance for gases to displace the fluid that is discharged from the container.

The logical operations making up the embodiments of the invention described herein are referred to variously as operations, steps, objects, or modules. Furthermore, it should be understood that logical operations may be performed in any order, adding or omitting operations as desired, unless explicitly claimed otherwise or the claim language inherently necessitates a specific order.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A fluid container comprising:

two or more matched pairs of recesses in a body of the container, each recess in a matched pair oriented on opposing sides of the container, the recesses configured to interface with hardware to physically manipulate the container;

two or more stiffening ribs, each stiffening rib extending between two of the recesses in the body of the container; and two or more input/output assemblies, each configured to selectively act as an input for fluid into the container, an output of fluid drawn from a straw extending to a low-point of the container when in a discharge orientation, and a vent for pressure equalization within the container to atmospheric pressure.

2. The fluid container of claim 1, wherein each recess in a matched pair has a base structure distinct from a base structure of an opposing recess in the matched pair.

3. The fluid container of claim 1, wherein each recess in a matched pair meets an opposing recess at a common base structure within the container.

4. The fluid container of claim 1, wherein each recess in a matched pair extends entirely through the container and is contiguous with an opposing recess in the matched pair.

5. The fluid container of claim 1, wherein each recess includes one of a countersink and a counterbore in the container body.

6. The fluid container of claim 1, wherein each recess includes a draft angle between 1 and 10 degrees.

7. The fluid container of claim 1, wherein each stiffening rib terminates with flared ends and is discontinuous with the two recesses it extends there between.

8. The fluid container of claim 1, wherein each stiffening rib is continuous with and connects the two recesses it extends there between.

9. The fluid container of claim 1, wherein each stiffening rib is a formed channel in the container body protruding one of inward and outward from the container body.

10. The fluid container of claim 1, wherein the two input/output assemblies are each recessed into the body of the container.

11. The fluid container of claim 10, wherein the two input/output assemblies each include a filter configured to filter contaminants from one or both of the fluid and a pressure equalization gas passing through the input/output assemblies.

12. The fluid container of claim 1, wherein one or both of a height to width aspect ratio and a length to width aspect ratio of the container body exceeds 4.

13. A method of using a fluid container comprising:

interfacing each of two or more matched pairs of recesses in a body of the container with manipulation hardware, each recess in a matched pair oriented on opposing sides of the container;

suspending the container from the recesses, wherein each of two or more stiffening ribs extend between two of the recesses in the body of the container;

filling the container with a quantity of fluid using one of two or more input-output assemblies while the container is oriented at a fill orientation and while venting the container to atmosphere for pressure equalization; and discharging the quantity of fluid from the container using a straw of one of the input-output assemblies extending to a low-point of the container when the container is re-oriented to a discharge orientation while venting the container to atmosphere for pressure equalization.

14. The method of claim 13, further comprising:

freezing the quantity of fluid within the container, with the container re-oriented to a phase-change orientation; and thawing the quantity of fluid within the container, with the container oriented at the phase-change orientation.

15. The method of claim 13, wherein one or both of the input/output assemblies are recessed into the body of the container.

16. The method of claim 13, wherein the fill orientation positions one of the input/output assemblies in a headspace of the container above another the other of the input/output assemblies.

17. The method of claim 14, wherein the phase-change orientation places both of the input/output assemblies in a headspace of the container.

18. The method of claim 13, wherein the low-point of the container is at one of a pair of troughs, each trough associated with one of the input/output assemblies to funnel fluid to its associated input/output assembly during output of fluid from the container.

19. A fluid container comprising:

two or more matched pairs of recesses in a body of the container, each recess in a matched pair oriented on opposing sides of the container, each recess extending entirely through the rigid fluid container and contiguous with an opposing recess in a matched pair, each recess including one of a countersink and a counterbore in the container body, and each recess configured to interface with hardware to physically manipulate the container;

two or more stiffening ribs, each stiffening rib extending between two of the recesses in the body of the container, and each stiffening rib terminating with flared ends and discontinuous with the two recesses it extends between; and two or more input/output assemblies recessed into the body of the container, each of the input/output assemblies configured to selectively act as an input for fluid into the container, an output of fluid drawn from a straw extending to a low-point of the container when in a discharge orientation, and a vent for pressure equalization within the container to atmospheric pressure.

20. The fluid container of claim 19, wherein one or both of a height to width aspect ratio and a length to width aspect ratio of the container body exceeds 4.

21. An array of fluid containers comprising:

a larger container with a profile matching two or more smaller containers, wherein there are two or more matched pairs of recesses in a body of each container, each recess in a matched pair oriented on opposing sides of each container, the recesses configured to interface with hardware to physically manipulate the containers; and two or more stiffening ribs, each stiffening rib extending between two of the recesses in the body of each container;

two input/output assemblies recessed into the body of each container and each configured to act as at least two of an input for fluid into each container, an output of fluid from each container, and a vent for pressure equalization within each container to atmospheric pressure.

22. The array of fluid containers of claim 21, wherein each of two or more matched pairs of recesses in the larger container align with one of the matched pairs of recesses in each smaller container.

23. The fluid container of claim 1, further comprising:

a pair of troughs, each associated with one of the input/output assemblies to funnel fluid to its associated input/output assembly during output of fluid from the container.

* * * * *